US009446617B2

(12) United States Patent
Petersen

(10) Patent No.: US 9,446,617 B2
(45) Date of Patent: Sep. 20, 2016

(54) REMOVABLE DIE PLATE FOR SELF-INKING STAMPS

(71) Applicant: Millennium Marking Company, Elk Grove Village, IL (US)

(72) Inventor: Craig Petersen, Elk Grove Village, IL (US)

(73) Assignee: Trodat GmbH (AT)

( * ) Notice: Subject to any disclaimer, the term of this patent is extended or adjusted under 35 U.S.C. 154(b) by 0 days.

(21) Appl. No.: 14/341,329

(22) Filed: Jul. 25, 2014

(65) Prior Publication Data

US 2016/0023493 A1 Jan. 28, 2016

(51) Int. Cl.

| | |
|---|---|
| ***B41K 1/42*** | (2006.01) |
| ***B41K 1/40*** | (2006.01) |
| ***B41K 1/50*** | (2006.01) |
| ***B41K 1/38*** | (2006.01) |
| ***B41K 1/54*** | (2006.01) |
| ***B41K 1/04*** | (2006.01) |

(52) U.S. Cl.

CPC . *B41K 1/40* (2013.01); *B41K 1/04* (2013.01); *B41K 1/38* (2013.01); *B41K 1/42* (2013.01); *B41K 1/50* (2013.01); *B41K 1/54* (2013.01)

(58) Field of Classification Search

CPC ..... B41K 1/04; B41K 1/38; B41K 1/40; B41K 1/42; B41K 1/50; B41K 1/54; B41K 3/54; B41K 3/56

USPC ..... 101/103–105, 108, 109, 327, 333, 334, 101/405, 406

See application file for complete search history.

(56) References Cited

U.S. PATENT DOCUMENTS

| | | | | |
|---|---|---|---|---|
| 4,676,162 | A * | 6/1987 | Phipps, Sr. | B41K 1/02 101/327 |
| 5,709,145 | A * | 1/1998 | Shih | 101/109 |
| 5,819,650 | A * | 10/1998 | Shih | 101/111 |
| 6,499,398 | B2 * | 12/2002 | MacNeil | B41K 1/50 101/327 |
| 6,679,165 | B2 | 1/2004 | Shih | |
| 7,011,024 | B1 * | 3/2006 | Shih | 101/334 |
| 8,104,402 | B2 * | 1/2012 | Feilecker | B41K 1/02 101/327 |
| 8,230,782 | B2 * | 7/2012 | Shih | 101/109 |
| 9,050,841 | B1 * | 6/2015 | Shih | |
| 2012/0017786 | A1 | 1/2012 | Shih | |

FOREIGN PATENT DOCUMENTS

| | | |
|---|---|---|
| CA | 1037313 A | 8/1978 |
| WO | 0056552 A1 | 9/2000 |

OTHER PUBLICATIONS

International Search Report and Written Opinion for Application No. PCT/US2015/041811 dated Oct. 19, 2015.

* cited by examiner

*Primary Examiner* — Blake A Tankersley
*Assistant Examiner* — Marissa Ferguson Samreth
(74) *Attorney, Agent, or Firm* — Lerner, David, Littenberg, Krumholz & Mentlik, LLP

(57) ABSTRACT

A stamp die assembly for a self inking stamp in which the die plate having printing indicia thereon is easily removable from the die frame. There are at least two locking bars on the die frame that engage in locking relationship at least two positioning tabs on the die plate. Locking tabs on the positioning tabs engage in a locking relationship the locking bars to securely attach the die plate to the die frame. The locking tabs are flexible so that when a force is applied to them they can be flexed to an unlocking position thereby releasing the die plate from the die frame.

6 Claims, 4 Drawing Sheets

REMOVABLE DIE PLATE FOR SELF-INKING STAMPS

BACKGROUND OF THE INVENTION

This invention relates to hand stamps and more particularly to a self-inking hand stamp. Self inking stamps are one type of hand stamp that are used to create ink impressions on paper or other materials. The self-inking stamps allow the user to continuously stamp pieces of paper or other materials by merely continuously depressing the operating handle. The handle actuates a reciprocating die frame that has a die plate with the printing indicia thereon. The die plate contacts an ink pad to be re-inked each time an impression is made. Generally the die plate reciprocates in a stamp frame to contact the ink pad and then rotates 180° to contact the paper surface on which it prints the impression.

One example of a self inking stamp is illustrated in U.S. Pat. No. 7,124,684. It can be seen in the '684 patent that there is an actuating handle that when depressed causes the stamp insert and printing plate to reciprocate between the raised inking position in which the printing plate contacts an ink pad, and the lowered or printing position in which the printing plate contacts the printing surface. Another example of a self inking stamp is illustrated in U.S. Pat. No. 7,011,024. This patent also illustrates a self-inking stamp that has a removable stamp die that is detachably mounted to a bracket that reciprocates when the handle of the stamp is actuated. As such it can be seen that self inking stamps are known in the art. The present invention is related to these self inking stamps but is directed to a uniquely removable die plate that allows the user to easily replace one die plate with another. This allows the user to replace a worn die plate or a different die plate with another impression thereon without throwing out the hand stamp.

SUMMARY OF THE INVENTION

The self-inking stamp has a stationary stamp frame on which is mounted an actuating handle that is operatively connected to a reciprocating die frame. The die frame has the die plate with a printing plate mounted on its bottom surface to transfer the image from the printing plate to the printing surface. An ink pad is mounted in the stamp frame so that the printing plate attached to the die plate contacts the ink pad each time the actuating handle is forced by means of springs to its upward position. In this manner continuous printing can be accomplished by the user.

The die plate has an opposite pair of positioning tabs that are received by locking bars on the die frame so that the tabs are locked in place by locking tabs or barbs located on the positioning tabs. The positioning tabs are flexible so that they snap in place around the locking bars on the die frame, yet can be released by the user applying pressure to the tabs to spread them apart so that they can be released from the locking bars. The tops of the tabs are tapered or beveled so that they will allow for some misalignment when the stamp frame and die frame is initially positioned and pushed onto the die plate so that it is easier for the user to attach the die plate to the die frame. This design allows the user to easily change die plates so that one stamp can be used for many stamping images by merely changing the die plates.

DESCRIPTION OF THE PREFERRED EMBODIMENT

Figure 1:
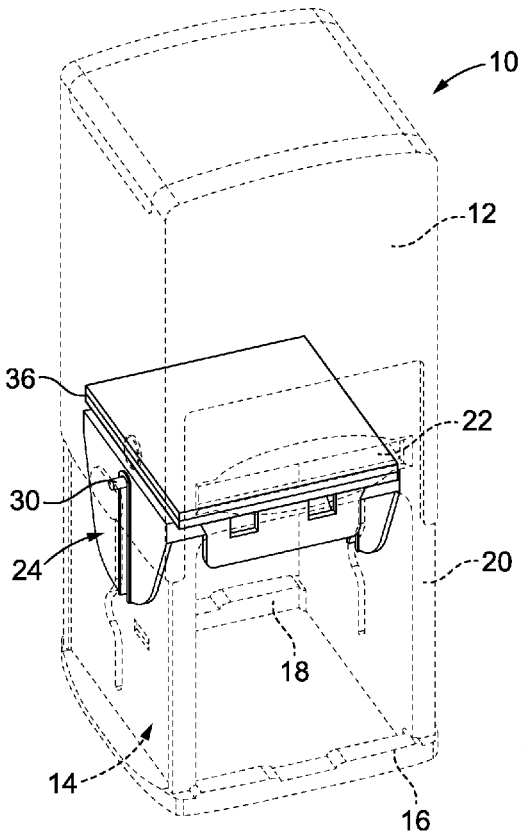
FIG. 1 is a perspective view of the self-inking stamp shown in dotted lines with the die frame and die plate in the top position to contact the ink pad within the stamp frame.

Turning first to FIG. 1, there is illustrated a hand stamp 10 in dashed lines that incorporates the present invention. The stamp 10 is a self inking stamp as described above and has an operating mechanism as previously taught in the prior art. There is an actuating handle 12 and can be provided with a locking mechanism (not illustrated) that allows the user to lock the actuating handle in the lowered or depressed position. Various locking mechanisms are taught in the prior art and can be self releasing or require the user to manually operate a slide or button to release the actuating handle 12. The stamp 10 has a front frame 16, a rear frame 18 and frame sides 20. An ink pad slot 22 is provided to receive an ink pad.

Figure 2:
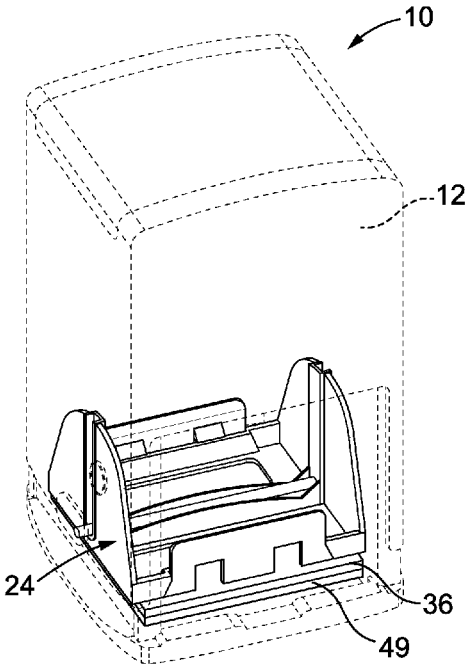
FIG. 2 is a perspective vie of the self-inking stamp shown in dotted lines with the die frame and die plate in the bottom or printing position with the actuating handle in the depressed position.
Figure 4:
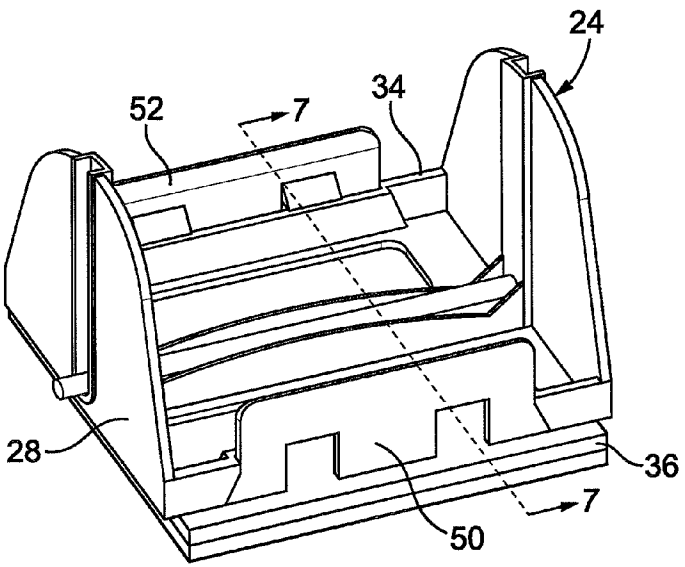
FIG. 4 is front top perspective view of the assembled die frame and die plate.

A die frame 24 is mounted to a reciprocating mechanism that is mounted in the actuating handle 12. The reciprocating mechanism causes the die frame 24 to rotate 180° from the raised or upper position in which the die frame faces the ink pad in the slot 22 and a lowered position in which the die frame 24 rotates and faces the printing surface, such as illustrated in FIG. 2.

Figure 3:
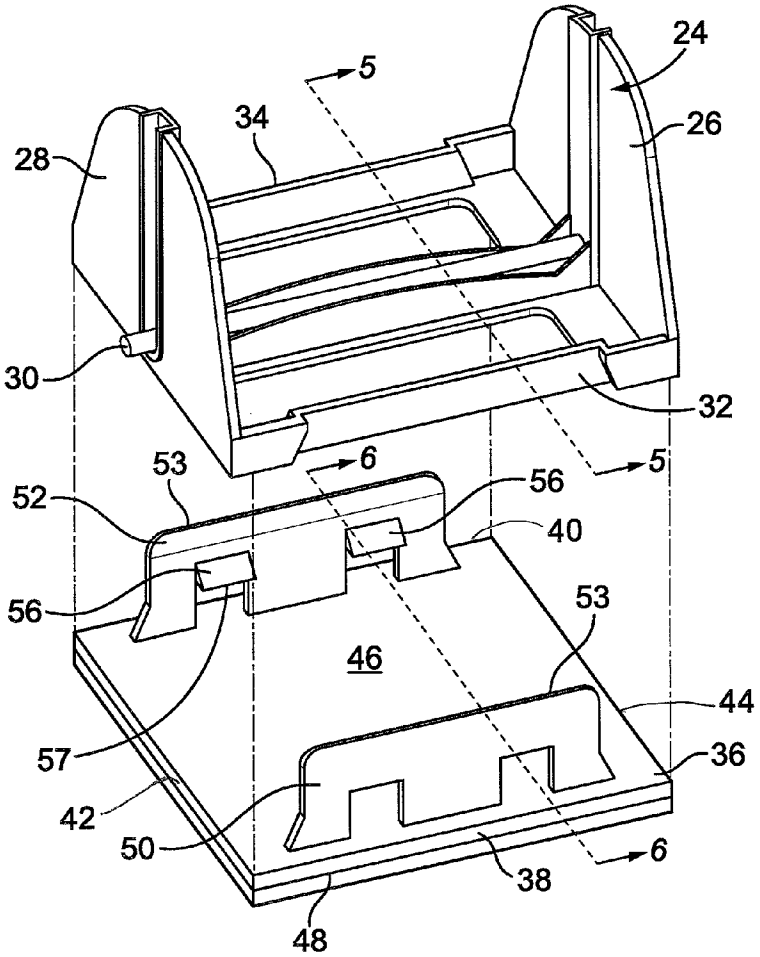
FIG. 3 is a top front perspective exploded view showing the die frame released from the die plate.
Figure 5:
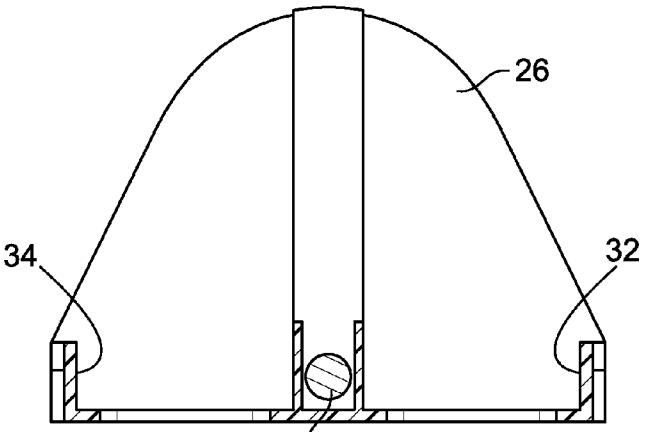
FIG. 5 is a cross sectional view taken along line 5-5 of FIG. 3 of the die frame and pivot pin.

The die frame 24 is most clearly illustrated in FIG. 3. There is a right support 26 and an opposite left support 28. A pivot rod 30 passes through the left and right supports 26, 28 and provides the pivot point about which the die frame 24 rotates from its raised to lowered positions. There is a front locking bar 32 and a rear locking bar 34 located respectively at the front and rear of the die frame 24. The locking bars 32 and 34 have a height "H" that will be described in greater detail below.

Also illustrated in FIG. 3 is a die plate 36 that has a front 38, a rear 40, and opposite sides 42, 44. The die plate 36 also has a top surface 46 and a bottom surface 48. Attached to the bottom surface 48 is a printing plate 49 that has printing indicia thereon. The printing plate 49 is of the type commonly used in stamps and is generally made of rubber with raised printing indicia that contacts the ink pad when the die frame is rotated into its raised position as illustrated in FIG. 1.

Figure 7:
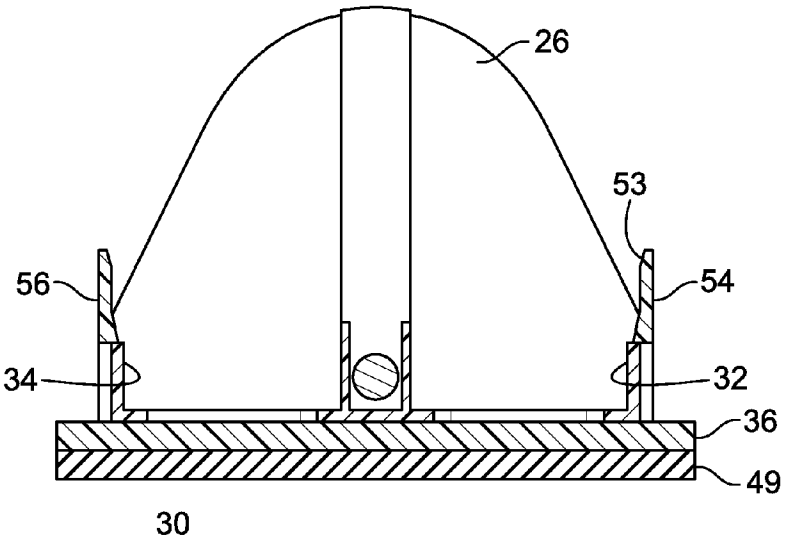
FIG. 7 is a cross section view taken along line 7-7 of FIG. 4 of the die frame, die plate and tabs in the locked, assembled position ready for printing.
Figure 6:
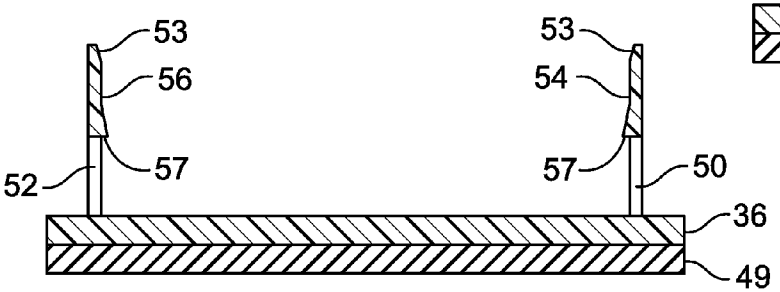
FIG. 6 is a cross section view taken along line 6-6 of FIG. 3 of the die plate and tabs.

Mounted on or integrally formed with the die plate 36 is an upstanding front positioning tab 50 and an upstanding rear positioning tab 52. There are front locking tabs 54 (seen in FIGS. 6 and 7) that extend tapering inwardly and rear locking tabs 56 as seen in FIGS. 3, 6 and 7 that also extend tapering inwardly. The locking tabs 54, 56 have a lower shoulder 57. The top surface of the front and rear positioning tabs 54, 56 have a tapered top edge 53.

To attach the die plate 36 to the die frame 24 the user places the die plate 36 with the printing plate 49 in the down or printing position inside the area defined by the front frame 16, rear frame 18 and frame sides 20. The user pushes down on the actuating handle 12 which forces the die frame 24 downward. The front and rear locking bars 32, 34 strike the tapered top edge 53 of the front and rear positioning tabs 50, 52 respectively. The distance between the front locking bar 32 and rear locking bar 34 is slightly less than the distance between the front positioning tab 50 and rear positioning tab 52 to allow the locking bars 32, 34 to enter the space between the positioning tabs 50, 52. The tapered top edge 53 on the positioning tabs further assists in positioning the locking bars 32, 34 between the positioning tabs 50, 52. The positioning tabs 50, 52 are made from a flexible material, such as plastic, to allow them to flex outwardly when an outward force is applied to them, yet have a memory that will cause the tabs 50, 52 to snap back to their original position when the force is removed.

The downward force applied to the actuating handle 12 pushes the locking bars 32, 34 against the tapering top surfaces of the locking tabs 54, 56. This causes the front positioning tab 50 and rear positioning tab 52 to flex outward allowing the front locking bar 32 and rear locking bar 34 to slide over the top tapered surface of the locking tabs 54, 56 until the top of the front locking bar 32 and top of the rear locking bar 34 slides past the shoulder 57 at which point the front and rear positioning tabs 50, 52 snap back into their original position with the front and rear locking bars 32, 34 locked in place below the shoulder 57 of the locking tabs 54, 56 respectively as seen in FIG. 7. Thus the die plate 36 is firmly locked in place against the die frame 24.

To release the die plate 36 from the die frame 24, the user grabs the top edges 53 of the front and rear positioning tabs 50, 52 and spreads them outwardly. This releases the locking tabs 54, 56 from engagement with the top of the locking bars 32, 34 allowing the die plate 36 to be released from the die frame. The user can then attach another die plate with other printing indicia thereon to the die frame 24 rather than replacing the entire hand stamp 10. Also when the printing plate 49 wears out, it can be replaced without replacing the entire stamp 10. Inventory is reduced as the user only needs to store differing die plates 36 rather than an entire stamp 10.

Figure 8:
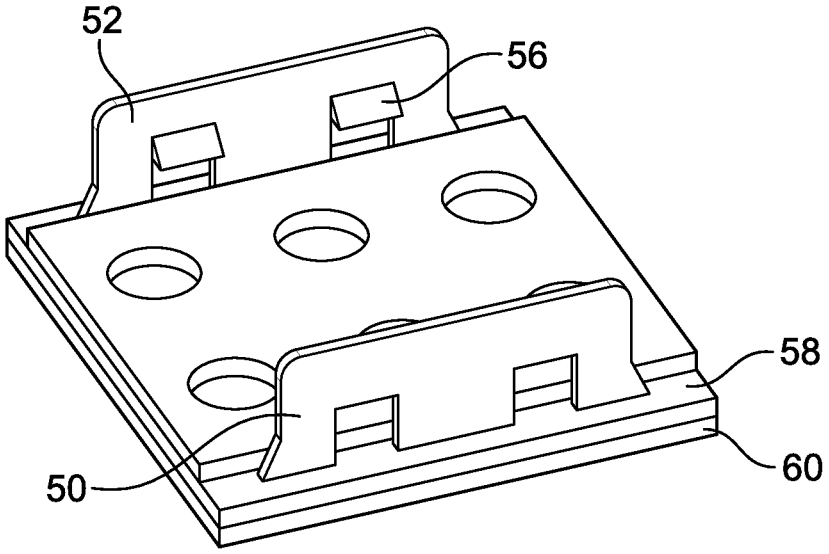
FIG. 8 is a front top perspective view of an alternative embodiment of the die plate having a pre-inked pad for providing ink to the printing surface of the die plate.

FIG. 8 illustrates an alternate embodiment of a die plate 58 having a printing plate or surface 60. This embodiment uses a pre-inked thermoplastic foam that allows ink to pass through certain areas of the foam and not through others, thereby forming the image that is to be printed. Examples of this technology are illustrated in U.S. Pat. No. 5,942,312 and U.S. Pat. No. 6,968,781, both patents incorporated herein by reference. Thus, the ink pad placed in the slot 22 is eliminated. In other respects the die plate 58 is attached to the die frame 24 in the same manner as previously described in the first embodiment.

Thus there has been provided a removable die plate for self-inking stamps. While the invention has been described in conjunction with specific embodiments, it is evident that many alternatives, modifications and variations will be apparent to those skilled in the art in light of the foregoing description. Accordingly, it is intended to embrace all such alternatives, modifications and variations as fall within the spirit and scope of the appended claims.

What is claimed is:

1. A stamp die assembly for a self inking stamp comprising:

a die frame having opposed upstanding side walls substantially parallel to each other, a front locking bar and a rear locking bar substantially parallel to each other and perpendicular to the upstanding side walls, a die plate having a front, back and opposite sides, a top surface and a bottom surface, a printing plate on the bottom surface of the die plate, the printing plate having printing indicia thereon, an upstanding front positioning tab adjacent to the front side of the die plate and an upstanding rear positioning tab adjacent to the rear side of the die plate, the front and rear positioning tabs being substantially parallel to each other and perpendicular to the opposite sides, a front locking tab on an upper position of the front positioning tab, a rear locking tab on an upper portion of the rear positioning tab, the front locking tab engaging the front locking bar and the rear locking tab engaging the rear locking bar for attaching the die plate to the die frame.

2. The stamp die assembly for a self inking stamp of claim 1 wherein the positioning tabs have a length that extends along the front of the die plate and a width that extends upward from and perpendicular to the top surface and a bottom edge on each of the positioning tabs that is attached to the top surface of the die plate.

3. The stamp die assembly for a self inking stamp of claim 2 wherein the positioning tabs are separated by a distance greater than the distance between the front and rear locking bars for allowing the locking bars to be inserted between the positioning tabs.

4. The stamp die assembly for a self inking stamp of claim 3 wherein the front locking tab engages the front locking bar and the rear locking tab engages the rear locking bar when the locking bars are inserted between the positioning tabs.

5. The stamp die assembly for a self inking stamp of claim 1 wherein the positioning tabs are flexible and can be spread apart from each other to disengage the front and rear locking tabs from the front and rear locking bars respectively thereby allowing the die plate to be released from the die frame.

6. The stamp die assembly for a self inking stamp of claim 1 wherein the positioning tabs have top edge having a tapered surface that engages the locking bars to assist in aligning the locking bars between the positioning tabs.

* * * * *